US006334324B1

(12) United States Patent
Muta et al.

(10) Patent No.: US 6,334,324 B1
(45) Date of Patent: Jan. 1, 2002

(54) EXPANSION DEVICE

(75) Inventors: Shunji Muta; Hiroshi Kanai; Kenji Iijima; Shunichi Furuya, all of Konan (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 0 days.

(21) Appl. No.: 09/743,024

(22) PCT Filed: Nov. 20, 1998

(86) PCT No.: PCT/JP98/05235

§ 371 Date: Jan. 4, 2001

§ 102(e) Date: Jan. 4, 2001

(87) PCT Pub. No.: WO00/31479

PCT Pub. Date: Jun. 2, 2000

(51) Int. Cl.[7] ..... F25B 41/04
(52) U.S. Cl. ..... 62/222
(58) Field of Search ..... 62/216, 222

(56) References Cited

U.S. PATENT DOCUMENTS 5,890,370 A * 4/1999 Sakakibara et al. ..... 62/222
6,012,300 A * 1/2000 Tomatsu et al. ..... 62/222

FOREIGN PATENT DOCUMENTS

JP 9-264622 10/1997
JP 10-89785 4/1998

* cited by examiner

*Primary Examiner*—William E. Tapolcal
*Assistant Examiner*—Mohammad M. Ali
(74) *Attorney, Agent, or Firm*—Wenderoth, Lind & Ponack, L.L.P.

(57) ABSTRACT

An expansion device capable of preventing an abnormal increase in the high-pressure in a freezing cycle and having, as an integrated unit thereof, a mechanism capable of quickly responding to an abnormal increase in the high-pressure and the low-pressure is provided. A means for displacement (bellows) 28 which becomes displaced in correspondence to the high-pressure is linked to a valve element 24 of a restrictor valve mechanism 32 to displace a rod 34 provided with a safety valve mechanism 33. If the high-pressure reaches a level equal to or higher than a first specific pressure (the limit to the normal operating pressure), a first portion 26 of the safety valve mechanism 33 becomes disengaged from a relief hole 27 that communicates between a high-pressure space 29 and a low-pressure passage 31 to be replaced by a second portion 25 which allows passage through the relief hole 27, thereby leaking the coolant in the high-pressure space 29 to the low-pressure passage 31 and preventing a further increase in the high-pressure. In addition, a low-pressure side rupture disk mechanism 40 that becomes ruptured if the low-pressure reaches a level equal to a second specific pressure to communicate between the low-pressure passage 31 and the atmosphere is provided at the low-pressure passage 31. A high-pressure side rupture disk mechanism 50 that becomes ruptured if the high-pressure reaches a level equal to or higher than a third specific pressure to communicate between the high-pressure passage 30 and the atmosphere is provided at the high-pressure passage 30.

7 Claims, 4 Drawing Sheets

EXPANSION DEVICE

TECHNICAL FIELD

The present invention relates to an expansion device employed in a freezing cycle in an air-conditioning system for vehicles and, more specifically, it relates to an expansion device having a mechanism for preventing an abnormality from occurring with regard to the high-pressure in a freezing cycle which uses carbon dioxide as a coolant.

BACKGROUND ART

In the freezing cycle disclosed in Japanese Unexamined Patent Publication No. H 7-25231 representing a typical example of the prior art, which uses a freon coolant and comprises, at least, a compressor that compresses the coolant, a condenser connected in series to the compressor, an expansion valve and an evaporator, an auxiliary coolant passage is provided in parallel to the expansion valve, a valve for opening/closing the auxiliary coolant passage is provided and the auxiliary coolant passage is opened if the low-pressure reaches a level equal to or lower than a specific value.

Thus, a reduction in the low-pressure is prevented by allowing the high-pressure to bypass the expansion valve to flow directly into the low-pressure side and the pressure on the outlet side of the compressor and the compression temperature are prevented from rising in this example.

In addition, there are freezing cycles provided with a low-pressure cutoff switch to turn off the cycle based upon a decision that the quantity of coolant is insufficient or that the temperature of the external air is low and, therefore, the load is low if the high-pressure reaches a level equal to or lower than a specific value.

Other safety mechanisms that may be provided in freezing cycles include a mechanism through which the operation of the compressor is stopped if the high-pressure reaches a level equal to or higher than a specific value, a mechanism through which the operation of the compressor is stopped if the compressor outlet temperature reaches a level equal to or higher than a specific value, a mechanism through which the high-pressure coolant is released into the atmosphere if the high-pressure reaches a level equal to or higher than a specific value and a fusible plug that allows the coolant to be released into the air if the coolant temperature reaches a specific value.

While concentrated efforts have been made to research into alternatives to freon, such as carbon dioxide ($CO_2$), to be used as coolant in a freezing cycle in air conditioning systems for vehicles in addressing the global environment issue, carbon dioxide has a low critical point of approximately 31.1° C. and, thus, a freezing cycle in which carbon dioxide is used as the coolant constitutes a super-critical cycle crossing over the critical point, resulting in the high-pressure therein reaching a level as high as 10 times the high-pressure in a freezing cycle using a freon coolant. When designing a heat exchanger and the like by taking into consideration the relevant safety factors, it is even more crucial to include a safety device for cycle protection in the freezing cycle in which an alternative coolant is used than in a freezing cycle (existing cycle) in the prior art that uses a freon coolant, since the high-pressure rises to a level close to the pressure withstanding limit of the aluminum material.

In more specific terms, the super-critical cycle described above, in which the normal operating pressure on the high-pressure side is approximately 10~15 MPa and the coolant does not cross over the critical point to become condensed, achieves characteristics whereby the high-pressure responds more sensitively to a load fluctuation compared to a cycle using a freon coolant in which the high-pressure side coolant becomes condensed. Accordingly, it has been confirmed that the likelihood of the high-pressure in a super-critical cycle reaching a level near the maximum normal operating pressure is far greater than the likelihood in the existing cycle. Thus, it becomes necessary to prevent an excessive rise in the high-pressure by responding to any increase in the high-pressure with a high degree of sensitivity.

In addition, in the super-critical cycle in which the critical point of the coolant is low, the balance pressure between the high-pressure side and the low-pressure side within the super-critical cycle increases as high as approximately 10 MPa if the cycle is left outdoors when the temperature is very high. Thus, it is necessary to protect the devices on the low-pressure side from such an increase in the balance pressure.

While a special safety means may be provided individually on the high-pressure line and the low-pressure line, it is more desirable to provide an entire safety mechanism at one component, e.g., the expansion device, from the viewpoint of achieving simplification in the structure of the freezing cycle and also simplification of the work process.

Accordingly, an object of the present invention is to provide an expansion device employed in a freezing cycle that uses carbon dioxide as the coolant, which is capable of preventing an abnormal increase in the high-pressure and responding quickly to abnormal rises in the high-pressure and the low-pressure.

SUMMARY OF THE INVENTION

In order to achieve the object described above, the expansion device according to the present invention, which is employed in a freezing cycle that uses carbon dioxide as a coolant and constitutes the freezing cycle together with, at least, a compressor that compresses the coolant to achieve a pressure in the super-critical range, a radiator that cools the compressed coolant and an evaporator that evaporates the coolant, having a valve housing, a high-pressure passage formed inside the valve housing through which the high-pressure coolant discharged from the radiator flows in, a restrictor valve mechanism provided on the downstream-most side of the high-pressure passage that reduces the pressure of the high-pressure coolant and a low-pressure passage through which the coolant, the pressure of which has been lowered by the restrictor valve mechanism, flows out to the evaporator, is further provided with a high-pressure space formed inside the valve housing and communicating with the high-pressure passage, a relief hole that communicates between the high-pressure space and the low-pressure passage, a means for displacement provided inside the high-pressure space that becomes displaced in correspondence to the pressure inside the high-pressure space, a rod passing through the relief hole that links the front end of the means for displacement and a valve element of the restrictor valve mechanism and a safety valve mechanism provided at the rod that is constituted of a first portion which has a diameter approximately equal to the diameter of the relief hole and blocks the relief hole and a second portion located between the first portion and the valve element of the restrictor valve mechanism, which has a diameter smaller than the diameter of the relief hole and opens the passage through the relief hole, and communicates between the high-pressure space and the low-pressure passage if the pressure inside the high-pressure space reaches a level equal to or higher than a first specific pressure.

As a result, the means for displacement that becomes displaced in correspondence with the level of the, high-pressure, displaces the rod provided with the safety valve mechanism and, if the high-pressure reaches a level equal to or higher than the first specific pressure (the limit of the normal operating pressure), the first portion of the safety valve mechanism blocking the relief hole becomes disengaged from the relief hole to be replaced by the second portion which allows passage through the relief hole, thereby leaking the coolant in the high-pressure space into the low-pressure passage to prevent an increase in the high-pressure. It is to be noted that the first specific pressure may be, for instance, 15 MPa.

In addition, it is desirable to provide a low-pressure side rupture disk that becomes ruptured if the low-pressure reaches a second specific pressure lower than the first specific pressure to allow the low-pressure passage to communicate with the atmosphere in the low-pressure passage. By providing such a rupture disk, the low-pressure side rupture disk, which becomes ruptured if the low-pressure rises to an abnormally high-level equal to or higher than the second specific pressure for any reason including the cycle having been left outdoors where the temperature is extremely high, and allows the low-pressure passage to become communicated with the atmosphere in such an event to release the coolant, thereby preventing any damage to the air conditioning devices provided on the low-pressure side is prevented. It is to be noted that the second specific pressure may be, for instance, 10 MPa.

Furthermore, it is desirable to provide a high-pressure side rupture disk that becomes ruptured if the high-pressure reaches a level equal to or higher than a third specific pressure which is higher than the first specific pressure to allow the high-pressure passage to become communicated with the atmosphere, in the high-pressure passage. By providing the high-pressure side rupture disk which becomes ruptured if the high-pressure reaches a level equal to or higher than the third specific pressure due to an abnormality, the high-pressure passage is allowed to communicate with the atmosphere to release the coolant in such an event, thereby preventing any damage to the air conditioning devices provided on the high-pressure side and the low-pressure side. It is to be noted that the third specific pressure may be, for instance, 17.5 MPa.

Moreover, it is desirable to constitute the means for displacement with a bellows that expands and contracts corresponding to the level of the high pressure. While the diaphragm may be used to constitute the means for displacement instead of a bellows, a bellows which is capable of assuring a sufficient displacement quantity will be preferable.

DETAILED DESCRIPTION OF THE INVENTION

The following is an explanation of an embodiment of the present invention, given in reference to the drawings.

Figure 1:
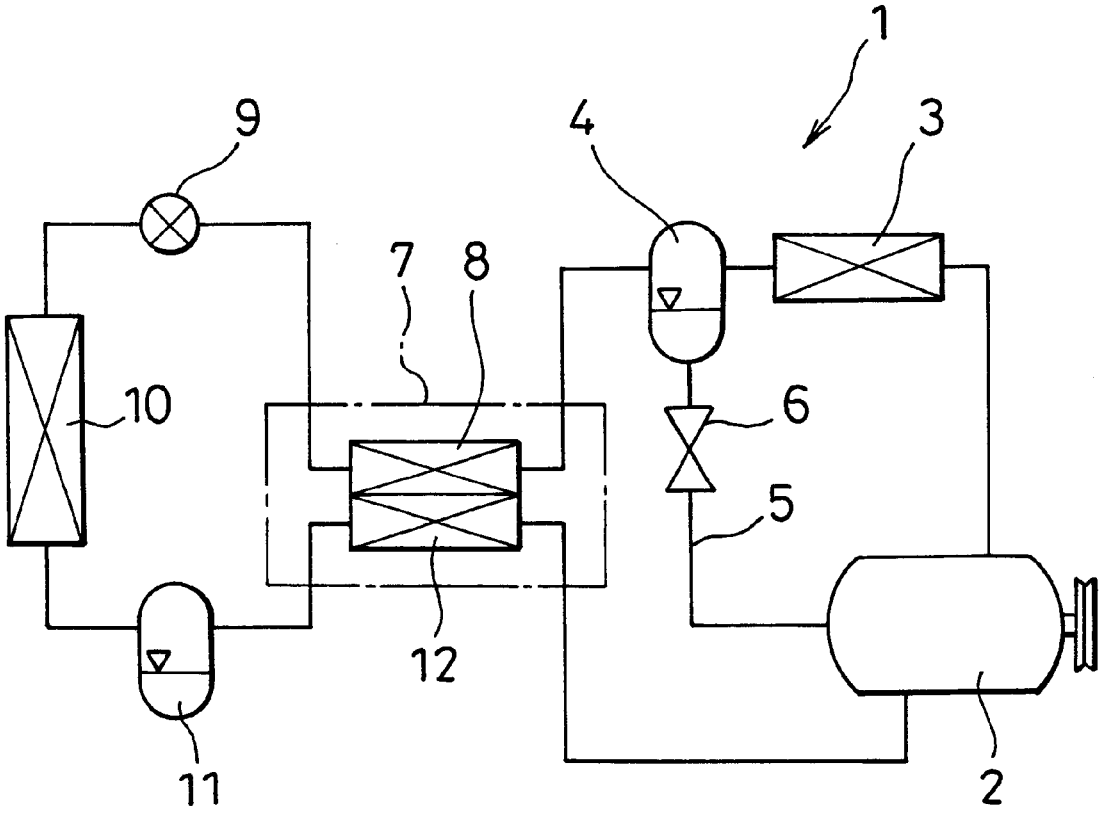
FIG. 1 is a block diagram of an example of the freezing cycle achieved in an embodiment of the present invention.

A freezing cycle 1 in the embodiment of the present invention shown in FIG. 1, which uses carbon dioxide as a coolant, comprises a compressor 2 that engages in operation by using the vehicle engine (not shown) as its drive source, a radiator 3 that cools the coolant having been compressed at the compressor 2 to achieve a pressure in the super-critical range and an oil separator 4 that separates a lubricating oil from the coolant having been cooled at the radiator 3. The lubricating oil having been separated at the oil separator 4 is returned to the compressor 2 via an oil return passage 5 which is opened/closed by a valve 6.

A first heat exchanger 8 constituting an internal heat exchanger 7 is provided on the downstream side of the oil separator 4. The coolant passing through the first heat exchanger 8 is further cooled through heat exchange with the coolant passing through a second heat exchanger 12 also constituting the internal heat exchanger 7 and reaches an expansion device 9 which is detailed below.

The expansion device 9 lowers the pressure of the coolant from the super-critical range to a gas/liquid mixed range, and the coolant whose pressure is lowered to a level in the gas/liquid mixed range at the expansion device 9 undergoes heat absorption and becomes evaporated at the evaporator 10. Subsequently, the gas-phase coolant undergoes gas/liquid separation at an accumulator 11, and becomes heated at the second heat exchanger 12 through the heat exchange with the coolant passing through the first heat exchanger 8 before it is returned to the compressor 2.

Figure 2:
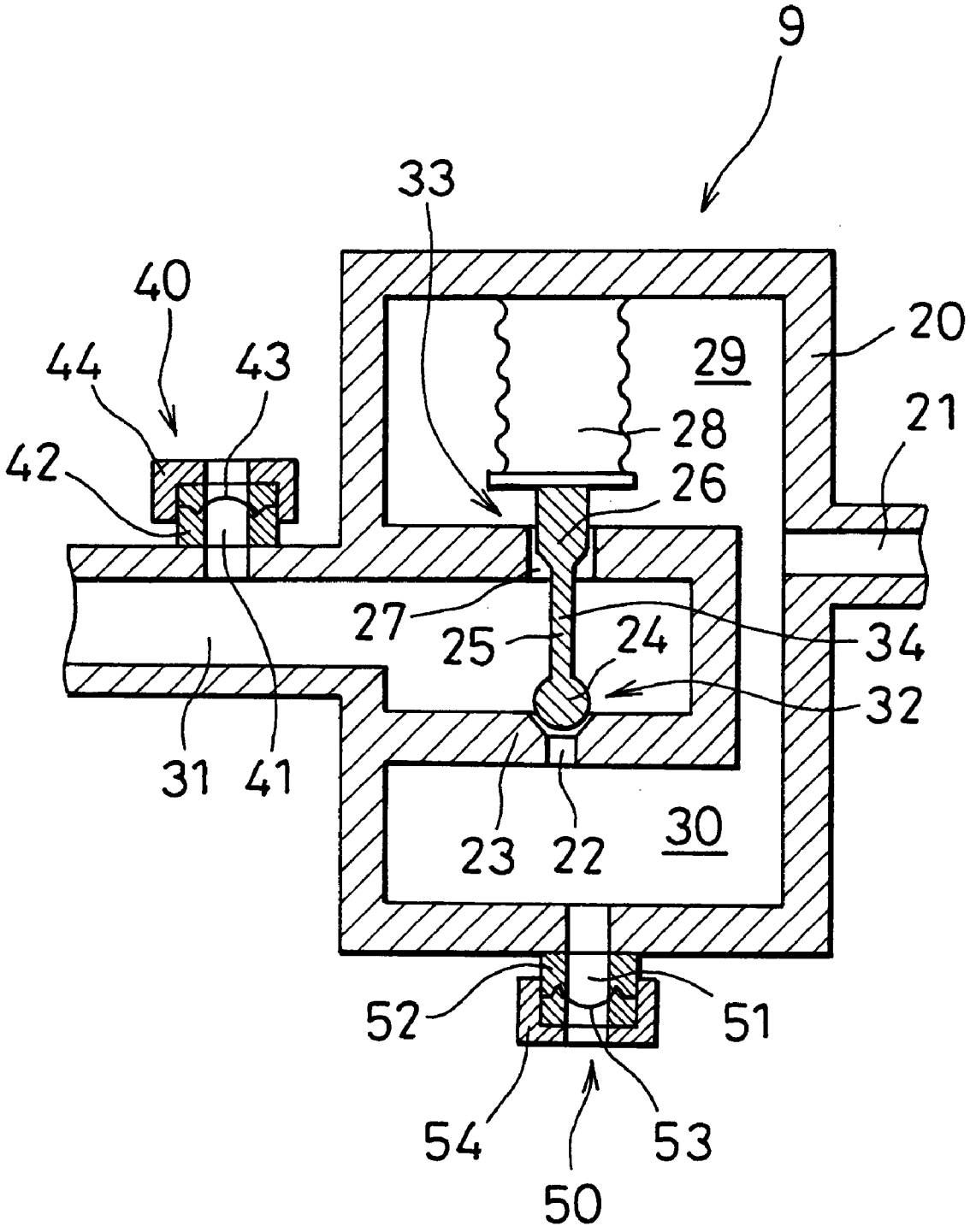
FIG. 2 is a sectional view of the structure of the expansion device according to the present invention.
Figure 3:
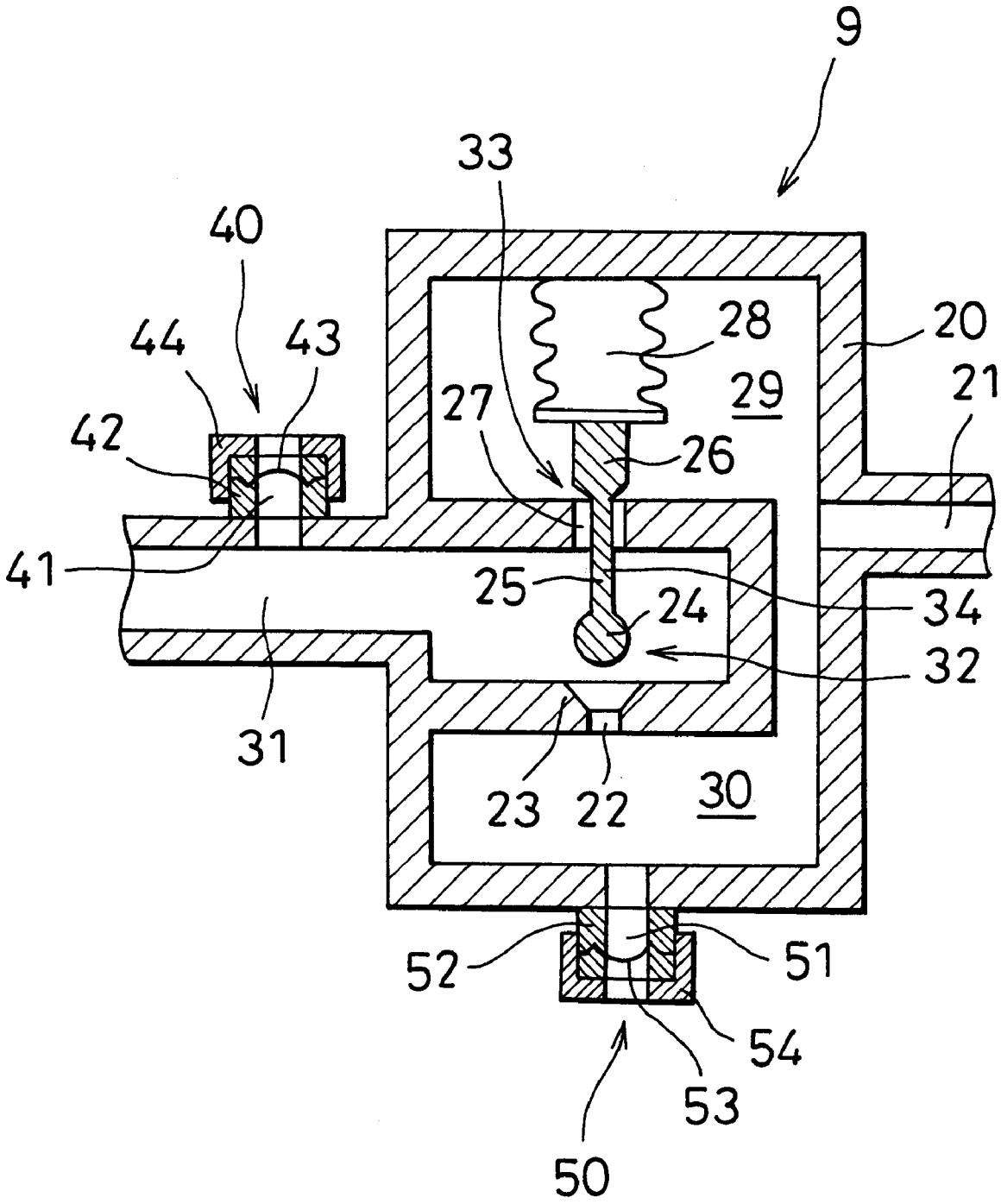
FIG. 3 is a sectional view of the expansion valve in a state in which a safety valve mechanism is engaged in operation.

As shown in FIGS. 2 and 3, the expansion device 9 employed in the freezing cycle 1 structured as described above is provided with a valve housing 20, a high-pressure passage 30 through which a high-pressure coolant flows in via the radiator 3, the oil separator 4 and the first heat exchanger 8 of the internal heat exchanger 7, a restrictor valve mechanism 32 located at the downstream-most position of the high-pressure passage 30 and constituted of a valve opening 22, a valve seat 23 and a valve element 24 and a low-pressure passage 31 through which the coolant flows out from the valve opening 22 of the restrictor valve mechanism 32 to the evaporator 10.

In addition, a high-pressure space 29 which communicates with an area near an intake 21 of the high-pressure passage 30 is provided inside the valve housing 20, with a bellows 28 provided inside the high-pressure space 29.

Inside the bellows 28, a vacuum state is achieved or a gas at a specific pressure is sealed so that the bellows 28 becomes expanded/contracted along a specific direction in correspondence to the pressure in the high-pressure space 29.

At the valve housing 20, a relief hole 27 which communicates between the high-pressure space 29 and the low-pressure passage 31 is formed at a position facing opposite the valve opening 22, with a rod 34 that links the front end of the bellows 28 to the valve element 24 of the restrictor valve mechanism 32 passing through the relief valve 27. At the rod 34, a safety valve mechanism 33 constituted of a first portion (relief hole blocking portion) 26 having an external diameter approximately equal to the internal diameter of the relief hole 27 and a second portion (relief hole opening portion) 25 having an external diameter smaller than the internal diameter of the relief hole 27 is formed.

Figure 4:
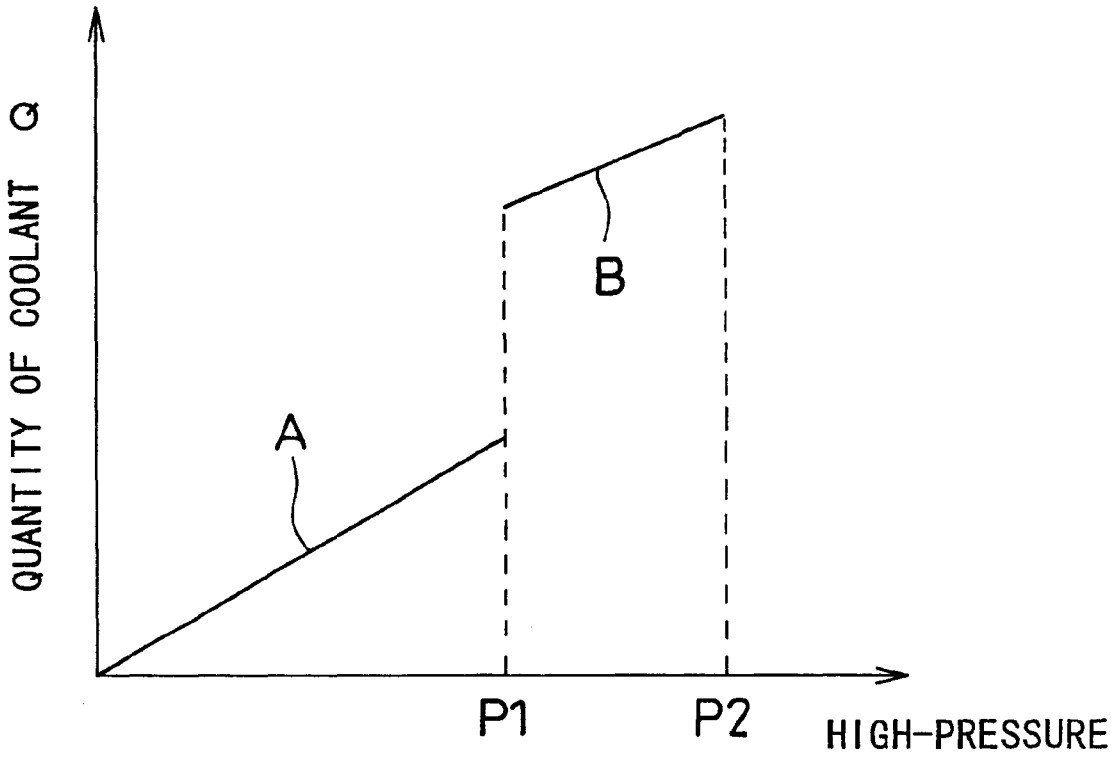
FIG. 4 presents a characteristics diagram indicating the relationship between the high-pressure in the expansion device and the quantity of the coolant flowing through the expansion device according to the present invention.

If the pressure inside the high-pressure space 29 reaches a level equal to, for instance, a first specific pressure (P1 in FIG. 4 which may be approximately 15 MPa in this embodiment), the range over which the bellows 28 contracts becomes large in the safety valve mechanism 33 and, as a result, the relief valve blocking portion 26 becomes disengaged from the relief hole 27 to allow the relief valve opening portion 25 to reach the relief hole 27 as illustrated in FIG. 3, resulting in the high-pressure space 29 and the low-pressure passage 31 becoming communicated with each other via the relief hole 27. In addition, since the opening area of the relief hole 27 subsequently increases in proportion to the pressure, the relationship between the high-pressure and the flow rate of the coolant flowing into the low-pressure side of the expansion device 9, which is determined in conformance to both the degree of valve opening at the restrictor valve mechanism 32 and the degree of valve opening at the safety valve mechanism 33, changes as indicated by the characteristics curve B in FIG. 4. It is to be noted that since the relief hole 27 is blocked by the relief valve blocking portion 26 of the safety valve mechanism 33 before the pressure reaches the first specific pressure P1, the coolant flow rate is accounted for by the flow rate achieved in correspondence to the degree of valve opening at the restrictor valve mechanism 32 alone. As a result, the relationship between the high-pressure and the coolant flow rate changes as indicated by the characteristics curve A in FIG. 4, and normal pressure control is executed to change the in correspondence to the high-pressure.

As described above, if the high-pressure rises to an abnormal level equal to or higher than the first specific pressure P1, the high-pressure space 29 and the low-pressure passage 31 become communicated with each other via the relief hole 21, thereby promoting an inflow of the high-pressure to the low-pressure side to prevent an abnormal rise in the high-pressure.

In addition, a low-pressure side rupture disk mechanism 40 that becomes ruptured if the low-pressure reaches a level equal to or lower than a second specific pressure (e.g., 10 MPa) is provided at the low-pressure passage 31. The low-pressure side rupture disk mechanism 40 is constituted of a rupture disk 43 that becomes ruptured at the second specific pressure, a holding portion 42 that holds the rupture disk 43 and defines a release passage 41 and a retaining portion 44 that retains the rupture disk 43 at the holding portion 42.

Thus, if the vehicle is left at a location where it is exposed to intense sun during the summer when the temperature of the outside air is high or the freezing cycle becomes heated for another reason, to result in the balance pressure (the pressure achieved in a state in which the high pressure and the low pressure are in balance after the operation of the compressor 2 is stopped) in the freezing cycle 1 rising to an abnormal level, for instance, and the low-pressure reaching the second specific pressure, the rupture disk 43 becomes ruptured to release the coolant within the low-pressure passage 31 into the atmosphere, thereby preventing an increase in the low-pressure and preventing any damage to the air conditioning devices on the low-pressure side such as the evaporator 10, the accumulator 11, the second heat exchanger 12 of the internal heat exchanger 7 and the piping.

In addition, a high-pressure side rupture disk mechanism 50, which becomes ruptured if the high-pressure reaches a third specific pressure (the pressure P2 in FIG. 4 which may be, for instance, 17.5 MPa) is provided at the high-pressure passage 30. The high-pressure side rupture disk mechanism 50 is constituted of a rupture disk 53 which becomes ruptured at the third specific pressure, a holding portion 52 that holds the rupture disk 53 and defines a release passage 51 and a retaining portion 54 that retains the rupture disk 53 at the holding portion 52.

As a result, if the operation of the safety valve mechanism 33 fails to lower the high-pressure and the high-pressure reaches the third specific pressure P2, the rupture disk 53 becomes ruptured to allow the high-pressure passage 30 to become communicated with the atmosphere via the release passage 51 and, thus, the high-pressure coolant is released into the atmosphere to lower the high-pressure, thereby preventing any damage to the air conditioning devices on the high-pressure side such as the radiator 3, the oil separator 4, the first heat exchanger 8 of the internal heat exchanger 7 and the piping and the air conditioning devices on the low-pressure side mentioned earlier, as well.

INDUSTRIAL APPLICABILITY

As explained above, according to the present invention, in which a bellows, for instance, is used to constitute the means for displacement to control the restrictor valve mechanism and the safety valve mechanism in correspondence to the absolute pressure of the high-pressure, quick response to a fluctuation of the high-pressure is achieved to improve the safety of the freezing cycle.

In addition, since an increase in the high-pressure is minimized by leaking the high-pressure into the low-pressure side until the high-pressure exceeds the operating pressure of the high-pressure side rupture disk mechanism, it is not necessary to release the coolant into the atmosphere. Consequently, it is not necessary to stop the operation of the freezing cycle itself when the high-pressure is caused to rise only temporarily, to assure continuous operation of the air conditioning devices.

Furthermore, with the safety valve mechanism, the low-pressure side rupture disk and the high-pressure side rupture disk provided as an integrated part of the expansion device, a sufficient means for safety is provided simply by mounting the expansion device in the freezing cycle, to achieve reductions in the production cost and in the number of manufacturing steps.

What is claimed is:

1. An expansion device constituting a freezing cycle in which carbon dioxide is used as a coolant together with, at least a compressor that compresses the coolant to achieve a pressure in a super-critical range; a radiator that cools the compressed coolant; and an evaporator that evaporates the coolant; and a valve housing; a high-pressure passage formed inside said valve housing, through which the high-pressure coolant discharged from said radiator flows in; a restrictor valve mechanism provided on the downstream-most side of said high-pressure passage that reduces the pressure of the high-pressure coolant; and a low-pressure passage through which the coolant, the pressure of which has been lowered by said restrictor valve mechanism flows out to said evaporator, characterized by comprising:

- a high-pressure space formed inside said valve housing and communicating with said high-pressure passage;
- a relief hole that communicates between said high-pressure space and said low-pressure passage;
- a means for displacement provided inside said high-pressure space that becomes displaced in correspondence to the pressure inside said high-pressure space;
- a rod passing through said relief hole that links the front end of said means for displacement and a valve element of said restrictor valve mechanism; and a safety valve mechanism provided at said rod that is constituted of a first portion which has a diameter approximately equal to the diameter of said relief hole and blocks said relief hole and a second portion located between said first portion and said valve element of said restrictor valve mechanism which has a diameter smaller than the diameter of said relief hole and opens a passage through said relief hole, and communicates between said high-pressure space and said low-pressure passage if the pressure inside said high-pressure space reaches a level equal to or higher than a first specific pressure.

2. An expansion valve according to claim 1, characterized in that:

a low-pressure side rupture disk that becomes ruptured if the low-pressure reaches a second specific pressure lower than the first specific pressure to allow said low-pressure passage to communicate with the atmosphere is provided at said low-pressure passage.

3. An expansion device according to claim 1, characterized in that a high-pressure side rupture disk that becomes ruptured if the high-pressure reaches a level equal to or higher than a third specific pressure higher than the first specific pressure to allow said high-pressure passage to become communicated with the atmosphere is provided at said high-pressure passage.

4. An expansion device according to claim 1, characterized in that:

said means for displacement is constituted of a bellows that expands/contracts in correspondence with the high-pressure.

5. An expansion device according to claim 2, characterized in that a high-pressure side rupture disk that becomes ruptured if the high-pressure reaches a level equal to or higher than a third specific pressure higher than the first specific pressure to allow said high-pressure passage to become communicated with the atmosphere is provided at said high-pressure passage.

6. An expansion device according to claim 2, characterized in that:

said means for displacement is constituted of a bellows that expands/contracts in correspondence with the high-pressure.

7. An expansion device according to claim 3, characterized in that:

said means for displacement is constituted of a bellows that expands/contracts in correspondence with the high-pressure.

* * * * *